US009738408B2

(12) United States Patent
Sobiech et al.

(10) Patent No.: US 9,738,408 B2
(45) Date of Patent: Aug. 22, 2017

(54) DEVICE FOR EMPTYING CONTAINERS

(71) Applicant: KRONES AG, Neutraubling (DE)

(72) Inventors: Bernd Sobiech, Regensburg (DE); Sabine Grosch, Ensdorf (DE)

(73) Assignee: Krones, AG, Neutraubling (DE)

( * ) Notice: Subject to any disclaimer, the term of this patent is extended or adjusted under 35 U.S.C. 154(b) by 0 days.

(21) Appl. No.: 14/440,368

(22) PCT Filed: Nov. 6, 2013

(86) PCT No.: PCT/EP2013/073194
§ 371 (c)(1),
(2) Date: May 4, 2015

(87) PCT Pub. No.: WO2014/072359
PCT Pub. Date: May 15, 2014

(65) Prior Publication Data

US 2015/0284125 A1 Oct. 8, 2015

(30) Foreign Application Priority Data

Nov. 6, 2012 (DE) ..... 10 2012 110 600

(51) Int. Cl.
*B65D 35/28* (2006.01)
*B65B 69/00* (2006.01)
*B67D 1/00* (2006.01)

(52) U.S. Cl.
CPC ..... *B65B 69/005* (2013.01); *B67D 1/0001* (2013.01)

(58) Field of Classification Search
CPC ..... B65B 69/005; B67D 1/001
(Continued)

(56) References Cited

U.S. PATENT DOCUMENTS 798,093 A * 8/1905 Dean ..... A61M 5/282 222/92
3,884,228 A * 5/1975 Hahn ..... A61M 5/148 128/DIG. 12

(Continued)

FOREIGN PATENT DOCUMENTS

DE 1108102 5/1961
DE 3618634 12/1987

(Continued)

OTHER PUBLICATIONS

China Office Action dated Jul. 1, 2015, issued in corresponding China Application No. 2013800016041.

(Continued)

*Primary Examiner* — Lien Ngo
(74) *Attorney, Agent, or Firm* — Onello & Mello, LLP.

(57) ABSTRACT

An apparatus for the removal of liquids from deformable containers comprises a first holding device which is suitable for holding a first portion of the container, a second holding device which is suitable for holding a second portion of the container, a drive device for producing a relative movement between the first holding device and the second holding device in order to deform in this way the container arranged between these holding devices in such a way that the internal volume thereof is reduced, and a removal device which is connected in terms of flow to the inner space of the container and by way of which the liquid is capable of being removed as a result of compression of the container.

19 Claims, 2 Drawing Sheets

Figure 3A:
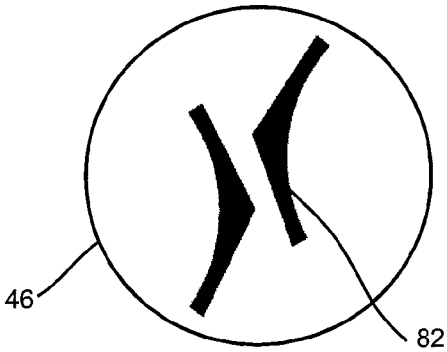

(58) Field of Classification Search
USPC ..... 222/95, 96, 83, 83.5, 214
See application file for complete search history.

(56) References Cited

U.S. PATENT DOCUMENTS

| | | | | |
|---|---|---|---|---|
| 5,206,037 | A * | 4/1993 | Robbins, III | B29C 53/08 264/295 |
| 5,240,144 | A | 8/1993 | Feldman | |
| 5,330,074 | A | 7/1994 | Wirsig et al. | |
| 5,348,392 | A * | 9/1994 | Bouquet | A61C 5/064 222/137 |
| 5,505,336 | A | 4/1996 | Montgomery et al. | |
| 5,878,915 | A * | 3/1999 | Gordon | B65D 43/02 222/105 |
| 6,789,707 | B2 | 9/2004 | Wright | |
| 7,137,538 | B2 | 11/2006 | Wright | |
| 9,370,198 | B2 * | 6/2016 | Gamburg | B65D 85/78 |
| 2003/0102333 | A1 * | 6/2003 | Wright | B65D 77/067 222/340 |
| 2005/0023307 | A1 | 2/2005 | Wright | |
| 2006/0054641 | A1 * | 3/2006 | Evers | B67D 1/0001 222/326 |
| 2010/0213210 | A1 * | 8/2010 | Drennow | B67D 1/0001 222/82 |
| 2013/0105512 | A1 * | 5/2013 | McGill | A23G 9/045 222/39 |
| 2015/0053716 | A1 * | 2/2015 | Meinzinger | B67D 3/0006 222/23 |

FOREIGN PATENT DOCUMENTS

| | | |
|---|---|---|
| DE | 2007054431 | 5/2009 |
| EP | 0820958 | 1/1998 |
| GB | 2178001 | 2/1987 |
| GB | 2186544 | 8/1987 |
| GB | 2436828 | 10/2007 |
| WO | 9208670 | 5/1992 |
| WO | 0142090 | 6/2001 |

OTHER PUBLICATIONS

German Search Report dated Aug. 5, 2013 issued in corresponding German Application No. 10 2012 100 600.2.

International Search Report and Written Opinion dated Mar. 3, 2014 issued in corresponding International Application No. PCT/EP2013/073194.

China Office Action dated Mar. 2, 2016 issued in corresponding China Application No. 2013800016041.

* cited by examiner

Fig. 1
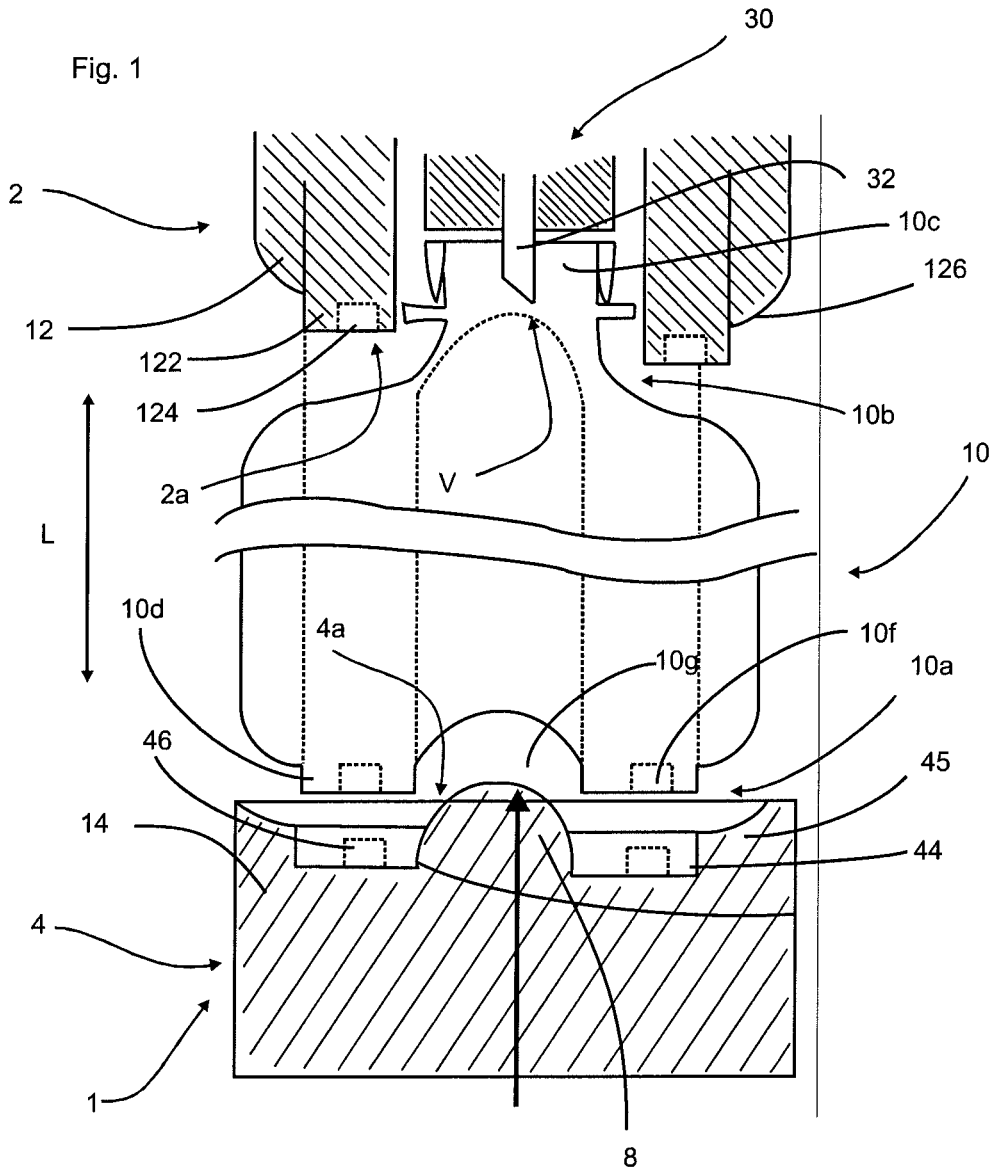
Fig. 2a
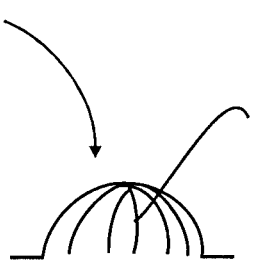
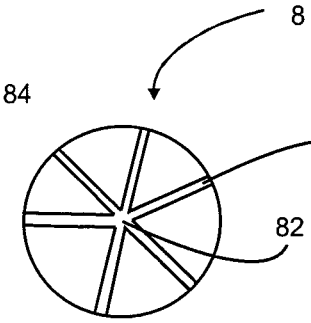
Fig. 2b

DEVICE FOR EMPTYING CONTAINERS

The present invention relates to an apparatus for the emptying of deformable containers and, in particular, plastics material containers. Apparatus of this type, also referred to in part as pump or dispensing plants, are known from the prior art. In this case a wooden or metal barrel was usually emptied in the past, in particular also with the aid of pressure.

In recent years, however, apparatus and methods are also known in which plastics material barrels are used. Plastics material barrels of this type have the advantage that they can be deformed during the emptying procedure.

In this way for example, DE 2007 054 431 A1 describes an apparatus for the removal of liquids from a container. A punch, which is adapted to a cross-section of the container in such a way that the latter is folded over during the deformation procedure, is used in this apparatus. In this way, a far-reaching emptying of the plastics material container is achieved. It has been found in this case that a folding over of the plastics material in this way can also be carried out without this tearing or rupturing during the emptying procedure.

The contents of the disclosure of DE 10 2007 054 431 A1 are hereby made the subject matter of the present disclosure by reference in its entirety.

On the basis of this prior art, however, the object is to achieve a still more far-reaching emptying for containers of this type of a deformable material. This object is attained according to the invention by the subjects of the independent claims.

Advantageous embodiments and further developments form the subject matter of the sub-claims.

An apparatus according to the invention for the removal of liquids from deformable containers and, in particular, from plastics material containers has a first holding device which is provided for and suitable for holding a first portion of the container. In addition, the apparatus has a second holding device which is provided for and suitable for holding a second portion of the container. In this case the second portion of the container is arranged at a distance from the first portion of the container. In addition, the holding devices are arranged in such a way that the container is capable of being arranged at least locally between these holding devices and is thus capable of being deformed by a relative movement of one holding device with respect to the other holding device. In addition, a drive device is preferably provided in order to produce this relative movement between the first holding device and the second holding device in order to deform in this way the container arranged between these holding devices in such a way that the internal volume thereof is reduced.

In addition, the apparatus has a removal device which is connected in terms of flow or is capable of being caused to be connected in terms of such flow to the inner space of the container and by way of which the liquid is capable of being removed as a result of compression of the container.

According to the invention the surfaces of the first holding device and the second holding device which are directed towards each other are adapted to each other at least locally in such a way that when the holding devices are brought up to each other a volume between these holding devices is capable of being minimized or is reduced with respect to the prior art respectively.

In this way, as compared with apparatus known from the prior art, it is proposed that the two holding devices or the surfaces thereof directed towards each other respectively should be adapted to each other geometrically. Until now this has been avoided, since it had been assumed that a complete or far-reaching compression of the plastics material container in this way was not possible and therefore a geometrical adaptation in this way was not appropriate, but could still result in damage to the container during the removal procedure.

The Applicants were able to discover, however, that the usual plastics material containers used are resistant in such a way that they can withstand even very far-reaching deformation without tearing or rupturing. A minimization of the volume between the holding devices is therefore not understood as being that the smallest geometrical volume is necessarily produced, but it is merely required that the surfaces of the holding devices directed towards each other are adapted to each other at least locally for the purpose of reducing this volume, for example by specific curves or projections in one holding device having opposite them corresponding curves or recesses respectively in the other holding device.

The drive device can be various drives, such as for example pneumatic drives, hydraulic drives or even electric motors. Manual drives, however, would also be possible, in particular whilst using reduction gearings. It is advantageous for the drive to be a spindle drive, i.e. a spindle can have the effect that one holding device is moved towards the other holding device.

In the case of a further advantageous embodiment one holding device is arranged in a stationary manner and the other is movable with respect to it. It is preferable for that holding device which carries the base portion of the container to be movable, since in this way the removal device can also be kept substantially stationary.

It is preferable for the movement of one holding device with respect to this other holding device to take place along a longitudinal direction of the container. This means that the container is compressed in its longitudinal direction for the removal of the liquid. It would also be possible, however, for the two holding devices to be moved in order to empty the container.

In the case of a further advantageous embodiment a carrier is provided on which is arranged at least one holding device. It is advantageous for the other holding device also to be arranged on a corresponding carrier.

In the case of a further advantageous embodiment a holding device extends in the longitudinal direction of the container and is preferably of a length which corresponds to at least one third of the total length of the container. This embodiment has the advantage of having a particularly small design.

In the case of a further advantageous embodiment the first holding device is used for holding a base region of the container. For this purpose the first holding device can have for example a recess into which a base region of the container can be introduced. In this case it would be possible for the holding device to be adapted to a shape of the base of the container. It would also be possible, however, for this holding device to be designed for example in the form of a hemisphere or in a similar manner. It is advantageous for the apparatus according to the invention to be designed in such a way that it is suitable for the removal of liquid from containers available in the trade. In particular, the apparatus is also designed in this case in such a way that it is suitable for the removal of liquids from containers which have standard closures, such as for example plastics material screw-type closures.

In the case of a further advantageous embodiment the second holding device is used for holding an aperture region of the container. It would be possible in this case for an internal surface of the first holding device to be adapted to an external surface of the container with respect to its geometrical shape. In this case, with suitably powerful drives, the container can be so thoroughly compressed that virtually the whole of the liquid can be removed from the container. In contrast to the case of the apparatus which is illustrated in DE 10 2007 054431 A1 and in which a special container is used, this is possible even in the case of those containers which have differently shaped bases, such as for example bases customary in the case of PET bottles, for example petaloid bases. It is advantageous for the second holding device to have a recess for receiving a closure of the container. The apparatus is accordingly particularly suitable for the removal of liquids and, in particular, beverages from PET plastics material containers which have a neck collar in a neck region. The aperture region with a neck collar can advantageously be situated in the second holding device, as a result of which the container is stabilized in the apparatus.

As mentioned above, the apparatus for the removal of the liquid can be implemented in this case with relatively simple means. By way of example, the PET container can be compressed by means of threaded spindles and an electrical drive in such a way that the container can be reduced to a very small volume in order to empty the container to a very small residual volume. It is advantageous for the container to be a container which has a size or a volume respectively between 2 and 10 liters and in an industrial application between 10 and 30 liters.

In the case of a further advantageous embodiment the first holding device and the second holding device are arranged in such a way that the container can be arranged vertically and with the aperture therefore directed upwards between them. In this way, it is possible to prevent liquid from escaping in an undesired manner in the event of a defect of the removal system for example.

In the case of a further advantageous embodiment the first holding device has a punch element which has a smaller cross-section than a base body of the container. In this way, the container can be folded in such a way that the internal volume thereof is reduced in an optimum manner. This has been explained in DE 10 2007 054 431 A1 mentioned above.

In the case of a further advantageous embodiment a distance between the first holding device and the second holding device can be altered in an initial state (which is, in particular, the state during the insertion of the container) in order to achieve the possibility of adjustment on different containers in this way. It would also be possible for the holding devices to be interchangeable or for adapter elements to be provided which permit an adaptation to different containers.

It is advantageous for at least one portion between the two holding devices to be formed without a housing. This means that at least one portion of the container to be compressed is not surrounded during the compression procedure by a directly adjacent housing. Such a directly surrounding housing would interfere with the movements of the holding devices. Whereas housings which support the containers during the emptying thereof are provided in the case of many removal apparatus in the prior art, the Applicants have discovered that housings of this type which are directly adjoined by the container are not absolutely necessary.

In the case of a further advantageous embodiment a shape of the second holding device is adapted to a shape of a base of the container to be emptied. It can therefore be possible for example for the holding device also to have a shape in the form of a petaloid if the base of the container to be emptied likewise has a shape of this type. In this way, a still more precise or more complete emptying of the container can be achieved. It is thus preferable for the holding device carrying the base of the container to be adapted to a shape of this base of the container. It is particularly preferred for the base of the container to form a stand area of the container at least in part.

In the case of a further advantageous embodiment the second holding device is interchangeable. This means that a preferably rapid change-over to different containers with, in particular, different container bases can be carried out.

It is advantageous for a shape of the first holding device also to be adapted at least locally to the shape of a base of the container to be emptied. In the case of this embodiment it is proposed that, in particular, that holding device which for example holds a head or shoulder region of the container should also be adapted in its shape to that of the base. In this way, when the two holding devices are brought up to each other the volume present between these two holding devices can likewise be reduced again. It is advantageous for the second holding device also to be interchangeable in order to achieve an adaptation to different container bases in this way.

In the case of a further advantageous embodiment the apparatus has a guide device which guides a relative movement between the first holding device and the second holding device in such a way that the first holding device and the second holding device are displaceable with respect to each other along a straight direction but are not rotatable with respect to each other. This means that the two holding devices are arranged so as to be rotationally fixed with respect to each other, as a result of which it can also be provided that, in particular, the surfaces of the two holding devices directed towards each other are adapted to each other, for example according to the key/lock principle. As a result, it is also possible, in particular, for containers to be compressed which have a cross-section which is not rotationally symmetrical.

In the case of a further advantageous embodiment in a central region of the first holding device the first holding device has a projection which faces in the direction of the second holding device. In this way for example, in the case of the design of a rotationally symmetrical container this projection can be formed in a central region, for example a circular area around the centre of this region. It is advantageous for this to be a region which contains a central axis of a container to be emptied. In the case of containers which have a substantially circular cross-section this is a region which contains an axis of symmetry of the container and preferably also a region with respect to which the axis of symmetry mentioned is likewise a geometrical axis of symmetry. It is advantageous for the central region to contact an injection point of the plastics material container during the emptying.

In this way, it is preferable for there to be lower lying regions around this region or this projection respectively, i.e. regions facing away from the interior space of the container.

It is advantageous for the aforesaid projection to be curved at least locally and to be shaped outwards in the manner of a dome at least locally and in a particularly preferred manner completely, or to have a profile in the shape of a hemisphere or a hemi-ellipse respectively. It is advantageous for the projection or the raised portion respectively to have a rotationally symmetrical cross-section, in particular a circular cross-section.

In the case of a further advantageous embodiment at least one duct for conveying a liquid, in particular of the medium to be emptied, is provided on a surface of this projection. In this case, this duct is used in particular during the compression procedure for shaping a corresponding duct in the compressed container.

In the case of a further advantageous embodiment a contour which can also advantageously be used for conveying liquids is formed in one of these projections. In this case a contour adapted geometrically in this way can also be provided in the opposite face of the other holding device.

In the case of a further advantageous embodiment the first holding device forms a contact face—which is at least locally circularly annular and in particular groove-shaped or arranged recessed respectively—for the container. In particular, this contact face is made continuous in this case. An annular stand area of the container to be emptied can be arranged in this case for example in this contact face. In this case the base structure of the container engages in the contact face. An engagement of the base structure of the container allows a locking of the base structure in the contact face and an optimum holding and an optimum standing of the container in the first holding device.

In the case of a further advantageous embodiment the removal device has a piercing device for piercing at least one wall of the container or a container closure of the container. In the case of this embodiment it is provided that the containers are not opened before they are removed, but are introduced directly into the apparatus and the latter pierces a wall of the container and, in particular, a wall of the closure. In the case of an advantageous embodiment the aforesaid piercing device is designed in the form of a tubular body which preferably has a cutting edge. This cutting edge is used to cut into the closure for example, so that the tubular body can then be introduced through the container closure into the container.

In the case of a further advantageous embodiment the removal device is incorporated into a holding device. In this case the removal device can be arranged on the holding device.

In the case of a further advantageous embodiment the second holding device is displaceable with respect to the piercing device. In this case it is possible for example for the second holding device first to hold a shoulder region of the container and for the piercing device then to be introduced into the container or to pierce the container closure respectively.

In the case of a further advantageous embodiment the holding devices and the piercing device are movable with respect to one another in particular in the longitudinal direction of the container. In this case it is also possible for the piercing device to be arranged in a stationary manner.

The present invention further relates to a method of removing liquids from a container, in which a container is arranged with a first portion on a first holding device and with a second portion—which is situated at a distance from the first portion—on a second holding device, in such a way that the container is situated at least locally between the first holding device and the second holding device, one holding device being brought to the other holding device in order to deform the container and in order to reduce the internal volume of the container in this way. In this case liquid is removed out of the container by means of a removal device.

According to the invention the surfaces of the first holding device and the second holding device which are directed towards each other are adapted to each other at least locally in such a way that when the holding devices are brought up to each other a volume between these holding devices is small or is minimized respectively. It is preferable for the aforesaid surfaces to be adapted to each other geometrically at least locally, for example according to the key/lock principle.

It is preferable for the container to be arranged standing upright between these holding devices. A minimization of the volume is therefore not necessarily understood in this case as being that the geometrically smallest possible volume is achieved, which would be achieved in the case of an exact adaptation of the holding devices to each other. It is understood from this, however, that the geometrical shape [of?] these holding devices is adapted to each other at least locally, so that a minimization of the volume is at least assisted.

It is advantageous for one of the two holding devices to be arranged in a substantially stationary manner and for the other to be moved relative to the latter.

It is particularly preferred for a guided relative movement between the holding devices to take place whilst observing the exact orientation of the holding devices.

Figure 3B:
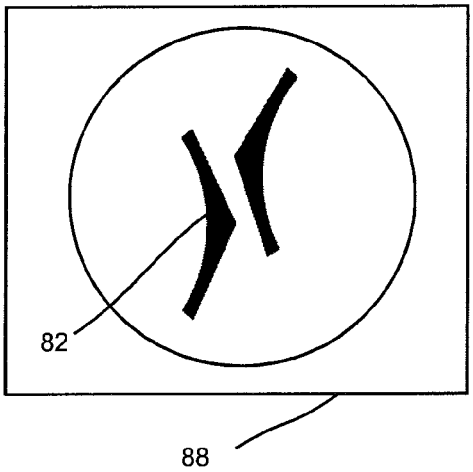
Figure 4:
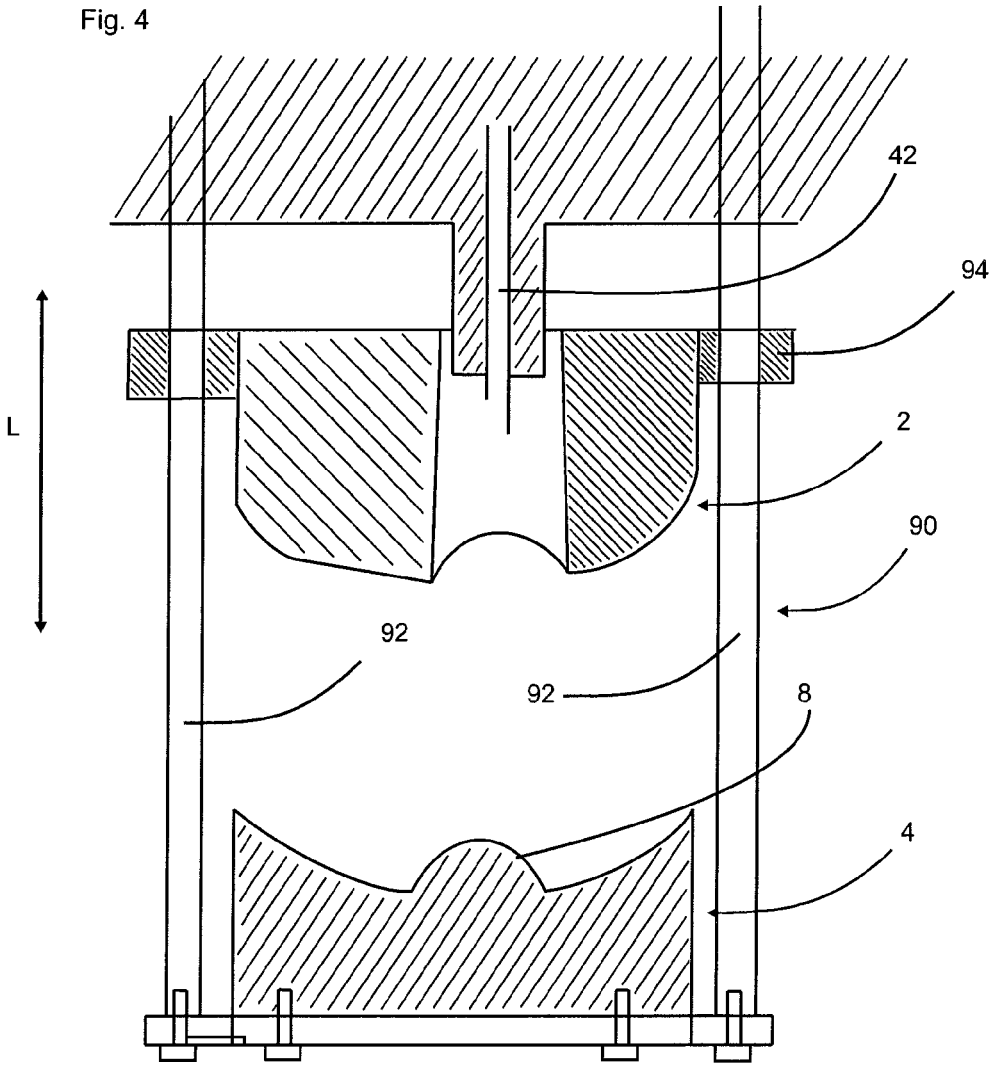

Further advantages and embodiments are evident from the accompanying figures. In the figures FIG. 1 is a first diagrammatic illustration of an apparatus according to the invention;

FIGS. 2*a*, 2*b* are two illustrations of the projection of the first holding device;

FIGS. 3*a*, 3*b* are two further illustrations of a design of the projection, and FIG. 4 is a further diagrammatic illustration of an apparatus according to the invention.

FIG. 1 is a first diagrammatic illustration of an apparatus according to the invention for the emptying of containers 10. In this case this apparatus 1 has a first holding device 2 which in this case holds a shoulder region 10*b* of the container. This shoulder region 10*b* also has an aperture portion 10*c* in this case. The reference number 30 designates a removal device which in this case has a piercing element 32 which can be introduced into the container through the closure of the latter.

The reference number 4 designates a second holding device, which in this case holds a base region 10*a* of the container. These two holding devices 2 and 4 can be brought up to each other in the direction. L which at the same time is also a longitudinal direction of the container. It will be seen that the regions 2*a* and 4*a* of the holding devices which are directed towards each other are adapted to each other in part with respect to their shape and, when brought up to each other to the maximum degree, can engage in each other. In this way, for example, the second holding device 4 has formed on it a projection 46 (in particular continuous) which engages on the one hand in a corresponding recess 10*f* in the container 10 or the base portion 10*a* thereof respectively and on the other hand, when the two holding devices 2 and 4 are brought up to each other, in a corresponding recess 124 which is provided in the first holding device 2.

The reference number 122 designates a projection which is likewise made continuous in this case and, when the holding devices 2, 4 are brought up to each other, can engage in the recess 44. In addition, the container 10 has a corresponding projection 10*d*. The reference number 126 designates a curved region which can likewise engage in a corresponding curved recess 45 in the second holding device. In addition, this portion is adapted in the shape thereof to the base of the container 10.

The reference number 8 designates a projection or the raised portion 8 respectively which is formed in a central region of the second holding device 4. This projection has in this case a dome-like structure which is likewise adapted to a corresponding recess 10*g* in the container. This projection helps with a still better emptying of the container, since liquid cannot build up in this region and, when the container is turned inside out, this region enters a shoulder region or aperture region 10*c* respectively, as indicated by the broken line V.

FIG. 2*a* is a first illustration of the projection 8. This projection (illustrated diagrammatically in this case) has a plurality of ducts 84 by way of which the liquid medium can flow. Alternatively, the ducts 84 can also be shaped outwards as raised portions.

FIG. 2*b* is a plan view of the projection 8 from FIG. 2*a*. The individual ducts 84, which, starting from a central recess 82, extend downwards in each case by way of the projection 8, are again evident here.

It is advantageous for this projection 8 or raised portion respectively to be designed in such a way that, when the two holding devices 2 and 4 are brought up to each other, it enters the internal contour of the aperture 10*c* of the container and, in this way, leads to an even better residual emptying. As shown in FIGS. 2*a* and 2*b*, this raised portion can be shaped outwards by a relief in the shape of an asterisk, as a result of which there are formed between the inner wall of the aperture and the raised portion small ducts which also allow even the last residue to flow out of the crushed bottle. This raised portion can also be part of a relief in this case and is supported by the holding means or the holding device 4 respectively. In this case it is also possible for this relief in the projection 8 to be designed in a circular annular shape and it preferably has an internal diameter which is greater [than] or equal to, and preferably equal to, the internal diameter of the receiving means of the aperture. In addition, in this way, the rolling behaviour on the shoulder 10*b* of the container is achieved in an improved manner (as compared to petaloid bottles for example).

FIGS. 3*a* and 3*b* are a further illustration of the projection, in which the ducts 84 are designed in the form of reliefs in this case. Here too these reliefs can again form the corresponding ducts 84 described above. In this way, it is possible for example, as shown in FIG. 3*b*, for a negative impression to be formed in the base of the holding device. In this case it is also possible for such a base of the holding device to be larger than a bottle base of the large container. The reference number 88 designates a frame or the boundary of the holding device respectively.

The reference number 46 again designates the continuous projection which again forms the stand area of the respective container.

In addition, a corresponding relief-like container base can be designed in such a way that the container base forms a stand area, so that the container or the large container respectively can be set on the base without falling over. In this way the stability of the container inside the apparatus can also be ensured, and also the steadiness when the container 10 is standing on a flat substructure.

In order to remove liquids, the container is introduced, as mentioned above, into the apparatus 1 and is then tapped. On account of the above-mentioned relief in the container base and the insertion of the container in the base the container is also stabilized by the two holding devices 2 and 4, since the base thereof fits into the corresponding negative impression of the second holding device 4.

A corresponding negative impression of the container in the base of the apparatus can also be already incorporated in the holding device 2 or the punch which deforms the containers into themselves and crushes them respectively. This holding device 2 can likewise in this case have the relief-like pattern shown in FIGS. 2*a* to 3*b*. In this case it is also possible for the second holding device 4 to be mounted so as to be rotatable, so that the user can introduce on the large container (which is also very heavy) in an improved manner into the corresponding negative impression of the second holding device 4. If the container is introduced into the aforesaid negative impression of the second holding device 4 in a proper manner, there is also the possibility of this rotatable mounting being locked and of the system then being properly mounted and no longer rotatable.

In addition, it is possible for a rotatable mounting and removal of the large container to be achieved if the large container is empty and reduced or also by a renewed rotation—actuated by the increased application of force—of the large container in one direction.

FIG. 4 shows a further embodiment of the apparatus 1 according to the invention. In the case of this embodiment a guide device 90 is also shown which in this case has two guide rods 92 with respect to which the first holding device 2 is arranged in a displaceable manner by means of a slide 94. In addition, the removal device 30 or the tubular body respectively is arranged in this case so as to be displaceable with respect to the first holding device 2. It is advantageous in this case for the removal device 30 or the piercing device 32 respectively to be arranged in a stationary manner. It would be advantageous, however, for the invention to be designed in such a way that, other than shown in FIG. 4, the removal of the liquid is carried out by the second holding device 4 being brought up to the first holding device 2.

In this way, in the case of this embodiment the punch or the holding device 2 respectively and the base holding means or the second holding device 4 respectively are displaceable towards each other by a guide, but are connected to each other in a manner preventing rotation so that the contours for the residual emptying are always precisely opposite each other. The base contour or the projection 8 respectively in the alignment of the receiving means of the aperture is not in this case an essential component of the base relief for the key/lock principle, since in this part the receiving means of the aperture is opposite the holding device 2. It is therefore proposed that the adaption of the two holding devices as illustrated above should be carried out not in a central region of the holding devices, but in a region radially on the outside thereof.

The Applicants reserve the right to claim all the features disclosed in the application documents as being essential to the invention, insofar as they are novel either individually or in combination as compared with the prior art.

LIST OF REFERENCES

1 apparatus
2 first holding device
2*a* surface of the first holding device
4 second holding device
4*a* regions of the holding device
8 projection in the central region of the second holding device 4
10 container
10*a* base region
10*b* shoulder region
10*c* aperture portion
10*d* projection
10*f* recess
10*g* recess of the container

30 removal device
32 piercing device
44 recess
45 curved recess
46 projection
82 central recess
84 ducts
88 frame of the holding device
90 guide device
91 guide rods
94 slide
122 continuous projection
124 recess
126 curved region
L longitudinal direction of the container, direction of movement

What is claimed is:

1. An apparatus for the removal of liquids from deformable containers comprising:

a first holding device constructed and arranged to hold a first portion of the container;

a second holding device constructed and arranged to hold a second portion of the container;

wherein the second portion of the container is positioned at a distance from the first portion of the container;

wherein the first and second holding devices are positioned relative to each other so that the container can be positioned between the first and second holding devices and can be deformed by a relative movement of one holding device with respect to the other holding device, and wherein one of the first and second holding devices has a curved projection and the other of the first and second holding devices has a recess opposite the container as the curved projection of the one of the first and second holding devices, the recess extending along a portion of, and not an entire width of, the other of the first and second holding devices, wherein a contact area between a bottom surface of the container and the second holding device is constant during the relative movement;

a drive device for producing the relative movement between the first holding device and the second holding device to deform the container positioned between the first and second holding devices so that the internal volume thereof is reduced; and a removal device in fluid communication with an inner space of the container so that liquid can be removed from the container as a result of the reduction of the internal volume of the container, wherein at least portions of bodies of the first holding device and the second holding device can be directed toward each other in accordance with the relative movement to cause the reduction in volume in the container positioned between them.

2. An apparatus according to claim 1, wherein a shape of the second holding device is adapted to a shape of a base of the container to be emptied.

3. An apparatus according to claim 1, wherein a shape of the first holding device is adapted to a shape of a base of the container to be emptied.

4. An apparatus according to claim 1, further comprising a guide device which guides a relative movement between the first holding device and the second holding device in such a way that the first holding device and the second holding device are displaceable with respect to each other along a linear axis and are fixed relative to each other in a direction of rotation.

5. An apparatus according to claim 1, wherein in a central region of the first holding device, the first holding device further comprises a projection which faces in the direction of the second holding device.

6. An apparatus according to claim 5, further comprising one or more ducts for conveying the medium to be emptied provided on a surface of the projection.

7. An apparatus according to claim 1, wherein the first holding device forms a contact face which is at least locally circularly annular for the container.

8. An apparatus according to claim 1, wherein the removal device has a piercing device for piercing at least one wall of the container or a container closure of the container.

9. An apparatus according to claim 8, wherein the second holding device is displaceable with respect to the piercing device.

10. A method of removing liquids from a container comprising:

arranging a container, a first portion of which is on a first holding device and a second portion of which is positioned at a distance from the first portion on a second holding device, so that the container is positioned at least locally between the first holding device and the second holding device;

moving the second holding device relative to the first holding device to deform the container in order to reduce the internal volume of the container, wherein one of the first and second holding devices has a curved projection and the other of the first and second holding devices has a recess opposite the container as the curved projection of the one of the first and second holding devices, the recess extending along a portion of, and not an entire width of, the other of the first and second holding devices; and removing liquid out of the container by means of a removal device during moving of the second holding device, wherein at least portions of bodies of the first holding device and the second holding device which are directed toward each other are adapted to each other at least in sections so that when the first and second holding devices are moved toward each other an internal volume of the container positioned between the first and second holding devices is reduced and a contact area between a bottom surface of the container and the second holding device is constant during the movement.

11. An apparatus according to claim 1, wherein the curved projection is in a circular area about a center of a region of the first or second holding device, which includes a central axis of the container to be emptied.

12. An apparatus according to claim 11, wherein the region of the first or second holding device includes an axis of symmetry of the container.

13. An apparatus according to claim 12, wherein the axis of symmetry is a geometrical axis of symmetry.

14. An apparatus according to claim 1, wherein the region of the first or second holding device includes lower lying regions about the curved projection, and wherein the lower lying regions include regions facing away from an interior space of the container.

15. An apparatus according to claim 1, wherein the curved projection is curved at least locally and shaped outwards in a dome-shape at least locally or has a profile in the shape of a hemisphere or hemi-ellipse.

16. An apparatus according to claim 1, wherein the curved projection has a rotationally symmetrical cross-section or circular cross-section.

17. An apparatus according to claim 1, wherein at least one portion between the first and second holding devices is formed without a housing, and wherein at least one portion of the container to be compressed is not surrounded during a compression procedure by a directly adjacent housing.

18. An apparatus according to claim 1, further comprising a projection on the second holding device, which engages either a recess in the container or a base of the container, and wherein when the first and second holding devices are positioned to be at or near each other, the projection engages a recess in the first holding device.

19. An apparatus for the removal of liquids from deformable containers comprising:

a first holding device constructed and arranged to hold a first portion of the container;

a second holding device constructed and arranged to hold a second portion of the container;

wherein the second portion of the container is positioned at a distance from the first portion of the container;

wherein the first and second holding devices are positioned relative to each other so that the container can be positioned between the first and second holding devices and can be deformed by a relative movement of one holding device with respect to the other holding device, and wherein one of the first and second holding devices has a curved projection and the other of the first and second holding devices has a recess opposite the container as the curved projection of the one of the first and second holding devices, the container partially inserted, and not entirely inserted, into the recess of the first holding device, wherein a contact area between a bottom surface of the container and the second holding device is constant during the relative movement;

a drive device for producing the relative movement between the first holding device and the second holding device to deform the container positioned between the first and second holding devices so that the internal volume thereof is reduced; and a removal device in fluid communication with an inner space of the container so that liquid can be removed from the container as a result of the reduction of the internal volume of the container, wherein at least portions of bodies of the first holding device and the second holding device can be directed toward each other in accordance with the relative movement to cause the reduction in volume in the container positioned between them.

* * * * *